United States Patent [19]

Huber

[11] 4,394,854

[45] Jul. 26, 1983

[54] METHOD AND APPARATUS FOR SEPARABLY CONNECTING CRANKSHAFTS IN INTERNAL COMBUSTION ENGINES

[75] Inventor: Lothar Huber, Bühl-Altschweier, Fed. Rep. of Germany

[73] Assignee: Luk Lamellen und Kupplungsbau GmbH, Bühl, Fed. Rep. of Germany

[21] Appl. No.: 233,890

[22] Filed: Feb. 12, 1981

[30] Foreign Application Priority Data

Feb. 13, 1980 [DE] Fed. Rep. of Germany ..... 3005343

[51] Int. Cl.[3] ..... F02D 17/02

[52] U.S. Cl. ..... 123/198 F; 123/52 A

[58] Field of Search ..... 123/198 F, 52 A

[56] References Cited

U.S. PATENT DOCUMENTS 4,069,803 1/1978 Cataldo ..... 123/198 F

FOREIGN PATENT DOCUMENTS 2828298 1/1980 Fed. Rep. of Germany ... 123/198 F

*Primary Examiner*—Tony M. Argenbright

*Attorney, Agent, or Firm*—Kontler, Grimes & Battersby

[57] ABSTRACT

A positive engagement clutch between the serially connected coaxial first and second crankshafts in an internal combustion engine is activated upon acceleration of the second crankshaft to the speed of the first crankshaft and after the second crankshaft assumes a predetermined angular position relative to the first crankshaft. The acceleration is performed by a friction clutch which is interposed between first and second camshafts which are respectively driven by and drive the first and second crankshafts. The first crankshaft and the associated camshaft form part of a normally operative first section of the engine wherein the first crankshaft is rotatable by one or more cylinders whenever the engine is running. The second crankshaft and the associated second camshaft form part of a second section of the engine wherein the crankshaft is rotatable by one or more additional cylinders upon direct coupling of the two crankshafts to each other. Each section of the engine may be installed in a discrete cylinder block or both sections may have a common casing.

53 Claims, 7 Drawing Figures

METHOD AND APPARATUS FOR SEPARABLY CONNECTING CRANKSHAFTS IN INTERNAL COMBUSTION ENGINES

CROSS-REFERENCE TO RELATED CASES

The following commonly owned copending applications are related to the present case:

(1) Ser. No. 233,959 filed Feb. 12, 1981, now U.S. Pat. No. 4,367,703, by Paul Maucher et al. for "Apparatus for engaging and disengaging discrete crankshafts in internal combustion engines".

(2) Ser. No. 233,960 filed Feb. 12, 1981, now U.S. Pat. No. 4,367,704, by Paul Maucher et al. for "Internal combustion engine with separable crankshafts".

(3) Ser. No. 233,952 filed Feb. 12, 1981 by Lothar Huber et al. for "Apparatus for establishing and terminating connections between crankshafts".

(4) Ser. No. 233,958 filed Feb. 12, 1981, now U.S. Pat. No. 4,368,701, by Lothar Huber et al. for "Internal combustion engine with means for separably coupling discrete crankshafts to each other".

BACKGROUND OF THE INVENTION

The present invention relates to a method and apparatus for separably connecting discrete crankshafts in internal combustion engines. More particularly, the invention relates to improvements in a method and apparatus for separably connecting discrete crankshafts in internal combustion engines of the type wherein each of several individual crankshafts can be rotated by a separate cylinder or group of cylinders.

It is already known to reduce the number of cylinders which are in actual use when an internal combustion engine (e.g., the engine of an automotive vehicle) is operated at less than maximum load. Such mode of operation entails considerable savings in fuel and reduces the rate of emission of deleterious combustion products into the surrounding atmosphere. The engine consists of several sections or units each of which comprises a crankshaft, a camshaft and one or more cylinders which can be put to use in order to rotate the respective crankshaft which, in turn rotates the associated camshaft. The crankshaft of one of the units or sections is rotated whenever the engine is running, and one or more additional sections are rendered operative when the operator of the vehicle decides to drive the engine at higher-than-minimum load. For example, a single group of cylinders will be set in operation immediately after starting as well as whenever the engine is to be operated at partial load.

German Offenlegungsschrift No. 28 28 298 discloses a method of operating an internal combustion engine wherein the engine is assembled of several sections or units each of which has an independent crankshaft adapted to be rotated by a discrete group of cylinders. The sections or units of the engine have a common cylinder block. When the operator decides to reduce the fuel consumption, one or more crankshafts are disconnected from a first crankshaft which rotates as long as and whenever the engine is running, and the cylinders which are associated with the disconnected crankshaft or crankshafts are brought to a standstill. In order to reconnect one or more crankshafts to the running crankshaft, it is necessary to accelerate the previously idle crankshaft or crankshafts to the speed of the running crankshaft and to ensure that the freshly accelerated crankshaft or crankshafts assume predetermined angular positions with reference to the running crankshaft. This is necessary in order to achieve satisfactory firing sequence of the cylinders.

OBJECTS AND SUMMARY OF THE INVENTION

An object of the invention is to provide a novel and improved method of changing the number of active cylinders in an internal combustion engine of the type wherein discrete cylinders or discrete groups of cylinders can rotate separate crankshafts.

Another object of the invention is to provide a method which renders it possible to repeatedly connect several crankshafts to each other in optimum orientation and without any damage to or excessive wear upon the component parts of the engine.

A further object of the invention is to provide a method which can be resorted to in connection with internal combustion engines for vehicles to save fuel and/or to reduce the emission of deleterious combustion products into the surrounding atmosphere.

An additional object of the invention is to provide a method which can be practiced by resorting to relatively simple, rugged, compact and inexpensive apparatus.

A further object of the invention is to provide a method which ensures proper angular positioning of several discrete crankshafts relative to each other prior to actual establishment of torque-transmitting connection or connections therebetween.

Another object of the invention is to provide a reliable method of varying the output of an internal combustion engine with attendant changes in fuel consumption and emission of combustion products.

An additional object of the invention is to provide a novel and improved apparatus for the practice of the above outlined method.

An ancillary object of the invention is to provide an internal combustion engine which embodies the just mentioned apparatus.

A further object of the invention is to provide an economical internal combustion engine which embodies the above mentioned apparatus and which can be operated in accordance with the improved method.

One feature of the invention resides in the provision of a method of establishing a separable connection between a rotating first crankshaft and a second crankshaft in an internal combustion engine wherein the first and second crankshafts respectively form part of discrete first and second engine sections or units and the first and second units of the engine respectively further comprise first and second cylinder means (each such cylinder means may include a single cylinder but preferably includes a group of several cylinders) for rotating the respective crankshafts and first and second camshafts which rotate with the respective crankshafts (e.g., in such a way that the RPM of the crankshaft is twice the RPM of the corresponding camshaft).

The method comprises the steps of accelerating the second crankshaft through the medium of the first camshaft (to this end, the first and second crankshafts can be disposed end-to-end and the first and second camshafts can also be disposed end-to-end, or one of the camshafts surrounds the other camshaft), and thereupon connecting the second crankshaft to the rotating first crankshaft.

In accordance with a presently preferred embodiment of the method, the accelerating step comprises accelerating the second crankshaft through the medium of the second camshaft (i.e., the first crankshaft rotates the first camshaft which rotates the second camshaft and the latter, in turn, rotates the second crankshaft) until the speed of the second camshaft at least approximates the speed of the first camshaft. The second crankshaft is preferably accelerated by the second camshaft until the speed of the second crankshaft at least approximates the speed of the first crankshaft. The accelerating step preferably further comprises moving the second crankshaft to a predetermined angular position relative to the first crankshaft preparatory to the connecting step. This can be readily achieved by monitoring the angular positions of the camshafts and terminating the accelerating step when the second camshaft assumes a predetermined angular position relative to the first camshaft.

In accordance with another feature of the method, the accelerating step is carried out in two stages during the first of which the second camshaft and the first camshaft (and hence the first and second crankshafts) are free to rotate relative to each other (for example, due to the provision of a friction clutch between the first and second camshafts and due to such actuation of the friction clutch that it allows for rotation of the first camshaft relative to the second camshaft while the first camshaft transmits torque to the second crankshaft through the medium of the second camshaft) and during the second of which no relative movement between the camshafts takes place. The connecting step may include establishing a positive torque-transmitting connection between the first and second crankshafts as soon as the accelerating step is completed, i.e., as soon as the rotational speed of the second crankshaft at least approximates the rotational speed of the first crankshaft and as soon as the second crankshaft assumes a predetermined angular position with reference to the first crankshaft. Alternatively, it may be sufficient, at least under certain circumstances, to merely establish a slippage-free frictional connection between the first and second crankshafts as soon as the latter is accelerated to the exact speed or close to the speed of the first crankshaft. In other words, the connection between the first and second crankshafts can be established by a positive engagement (jaw or profiled) clutch or by resorting to a friction clutch. The connecting step can be carried out in response to completion of the accelerating step or simultaneously with completion of acceleration of the second crankshaft (in other words, completion of the accelerating step can trigger the connecting step or the connecting step can begin after the elapse of a certain period of time which suffices to ensure adequate acceleration of the second crankshaft).

The method preferably further comprises the step of terminating the accelerating action upon the second crankshaft upon completion of the connecting step. Thus, if the accelerating step is performed by resort to a friction clutch and the connecting step is performed by resort to a claw or jaw clutch, the friction clutch can be disengaged upon completion of engagement of the jaw or claw clutch. The terminating step can include interrupting the torque-transmitting connection between the first and second camshafts, i.e., disconnecting the second camshaft from the first camshaft as soon as the second crankshaft can directly receive torque from or can directly transmit torque to the first crankshaft.

The friction clutch between the camshafts can be designed in such a way that it establishes, at least for a certain interval of time (which is needed to complete the connecting step), a positive (i.e. completely slippage-free) connection between the first and second camshafts as soon as the speed of the second camshaft equals or closely approximates the speed of the first camshaft and preferably also as soon as the second camshaft assumes a predetermined angular position with reference to the first camshaft (which is tantamount to ensuring that the second crankshaft assumes a predetermined angular position with reference to the first crankshaft).

The novel features which are considered as characteristic of the invention are set forth in particular in the appended claims. The improved engine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
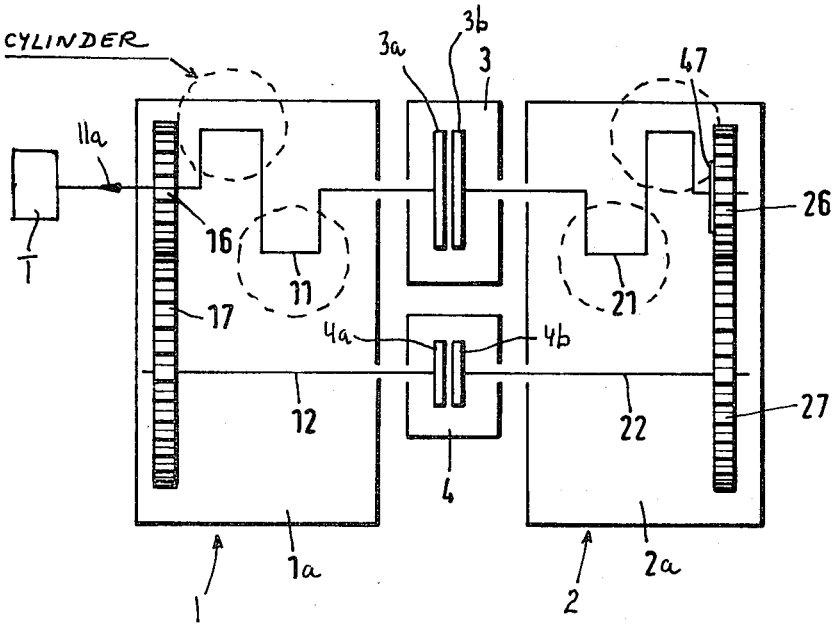
FIG. 1 is a diagrammatic sectional view of an internal combustion engine with two serially connected crankshafts and two discrete casings, the accelerating clutch being installed between the two camshafts.

Referring first to FIG. 1, there is shown an internal combustion engine which comprises two discrete sections or units 1 and 2 each having a separate cylinder block or casing 1*a*, 2*a*. The first unit 1 comprises a first crankshaft 11 which rotates a parallel camshaft 12 through the medium of a torque-transmitting gear train including spur gears 16 and 17. The angular velocity of the crankshaft 11 is twice the angular velocity of the camshaft 12.

The second unit or section 2 of the internal combustion engine shown in FIG. 1 comprises a discrete second crankshaft 21 which is parallel with the associated camshaft 22 and rotates the latter (or can be rotated by the latter) through the medium of a second torque-transmitting gear train including mating spur gears 26 and 27. The ratio of the gears 26, 27 is the same as the ratio of the gears 16, 17. The cylinders which rotate the crankshafts 11 and 21 are shown schematically be broken-line circles. It is assumed that the crankshaft 11 can be rotated by a first pair of cylinders, and that a second pair of cylinders can rotate the crankshaft 21. The arrangement is such that the crankshaft 11 is rotated whenever the engine is on. This means that the camshaft 12 also rotates whenever the crankshaft 11 is driven by the respective cylinders. The reference character 11*a* denotes the output portion which transmits motion to the transmission T of the vehicle. The transmission T is of conventional design and is not shown in detail in FIG. 1. The space between the units 1 and 2 accommodates a clutch 3 which is a positive-engagement (e.g., a jaw or claw) clutch and can establish a torque-transmitting connection between the crankshafts 11 and 21 when its clutch members 3*a*, 3*b* are in positive torque-transmitting engagement with each other. The aforementioned space further accomodates a clutch 4 which is an accelerating friction clutch and serves to increase the angular velocity of the camshaft 22 to the angular velocity of the camshaft 12 before the clutch 3 is engaged to establish a positive torque-transmitting connection between the crankshafts 11 and 21.

The crankshafts 11 and 21 are disposed in series, i.e., they are coaxial with each other, and the clutch 3 is disposed between those end portions of the two crankshafts which face each other in the space between the cylinder blocks or casings 1*a*, 2*a*.

The operation of the engine which is shown in FIG. 1 is as follows:

It is assumed that the engine is operated at partial load, i.e., the cylinders of the left-hand set rotate the crankshaft 11 which drives the transmission T and transmits torque to the corresponding camshaft 12 through the medium of gears 16 and 17. The clutches 3 and 4 are disengaged so that the crankshaft 21 and the associated camshaft 22 are idle.

If the operator of the vehicle desires to operate the engine at maximum load, the accelerating clutch 4 is engaged or activated so that the camshaft 12 begins to rotate the camshaft 22 and the camshaft 22 rotates the crankshaft 21 through the medium of the gear train 26, 27. The clutch 3 between the crankshafts 11 and 21 is engaged, preferably automatically, as soon as the angular velocity of the camshaft 22 matches or closely approximates the angular velocity of the camshaft 12. At such time, the angular velocity of the crankshaft 21 matches or closely approximates the angular velocity of the crankshaft 11. This will be readily appreciated since the ratio of the gear train 16, 17 is identical with the ratio of the gear train 26, 27.

Prior to engagement of the clutch 3, it is necessary to ensure that the crankshaft 21 assumes a predetermined angular position with reference to the crankshaft 11 so as to guarantee the firing of all cylinders in a predetermined sequence. Such proper angular positioning of the crankshaft 21 with reference to the crankshaft 11 can be achieved in a number of ways. For example, each of the two clutch elements 4*a*, 4*b* can carry a projection, and such projections bear against each other when the camshaft 22 assumes a predetermined angular position with reference to the camshaft 12 at which time the crankshaft 21 assumes a predetermined position with reference to the crankshaft 11. Alternatively, it is possible to provide one of the two clutch elements 4*a*, 4*b* with an eccentric recess which receives a complementary projection of the other clutch element when the camshaft 22 assumes the desired angular position with reference to the camshaft 12. Reference may be had to the aforementioned copending applications which describe such friction clutches. The copending applications further describe the means for automatically engaging the clutch 3 as soon as the camshaft 12 ceases to rotate relative to the camshaft 22, i.e., as soon as the crankshaft 21 assumes the desired angular position with reference to the crankshaft 11. This can be achieved by resorting to a suitable shifting or control device which moves one of the clutch members 3*a* and 3*b* axially of the crankshafts 11, 21 into positive torque-transmitting or torque-receiving engagement with the other clutch member. It goes wthout saying that the clutch 3 need not necessarily constitute a positive-engagement clutch. Thus, this clutch may constitute a friction clutch which is fully engaged, so that the crankshaft 11 can rotate with the crankshaft 21 without any slippage, as soon as the clutch 4 is fully engaged. The accelerating clutch 4 is preferably disengaged as soon as the engagement of the clutch 3 is completed. In other words, the transmission of torque between the coaxial camshafts 12 and 22 can be terminated as soon as the clutch 3 guarantees slippage-free transmission of torque between the crankshafts 11 and 21. The manner in which the friction clutch 4 can be disengaged in response to or simultaneously with full engagement of the clutch 3 is disclosed in the aforementioned copending applications.

It is also within the purview of the invention to provide electronic or other monitoring means for the angular velocity of the crankshafts 11, 21 and/or camshafts 12, 22 and to activate the clutch 3 between the crankshafts 11 and 21 when the monitoring means indicate that the angular velocity of the crankshaft 21 closely approximates or matches the angular velocity of the crankshaft 11. Such electronic monitoring means are described and shown in the aforementioned copending applications.

The clutch 4 need not establish a positive mechanical connection between the camshafts 12 and 22 when the angular velocity of the camshaft 22 equals or closely approximates that of the camshaft 12. In other words, it is normally satisfactory to establish a sufficiently strong frictional engagement between the elements 4*a*, 4*b* of the clutch 4 at the time when the clutch 3 is engaged to establish a direct and positive torque-transmitting connection between the crankshafts 11 and 21. Those end faces of the clutch members 3*a* and 3*b* in the clutch 3 which face each other can be provided with suitable profiles (such as annuli of alternating teeth and tooth spaces) which move into positive engagement with each other in response to axial movement as soon as the angular velocity of the crankshaft 21 equals or closely approximates the angular velocity of the crankshaft 11 and the crankshaft 21 assumes the desired angular position with reference to the crankshaft 11. The accelerating clutch 4 is preferably deactivated or disengaged as soon as the clutch members 3*a*, 3*b* of the clutch 3 move into positive torque-transmitting engagement with each other.

Since the engine of FIG. 1 comprises two discrete units or sections 1, 2 each of which has its own casing or block 1*a*, 2*a*, the clutches 3 and 4 can be installed in the space between the two casings. Therefore, each of the clutches 3 and 4 can constitute a dry clutch. However, it is equally possible to install one of the clutches 3, 4 outside of the casings 1*a*, 2*a* and to install the other clutch in the interior of one of the casings. For example, the clutch 4 can be installed between the casings 1*a*, 2*a* and the clutch 3 (which then constitutes a wet clutch)

can be installed in the casing 1*a* or 2*a*. Analogously, it is possible to install a dry clutch 3 in the space between the casings 1*a*, 2*a* and to utilize a wet accelerating clutch 4 which is installed in the casing 1*a* or 2*a*.

Figure 2:
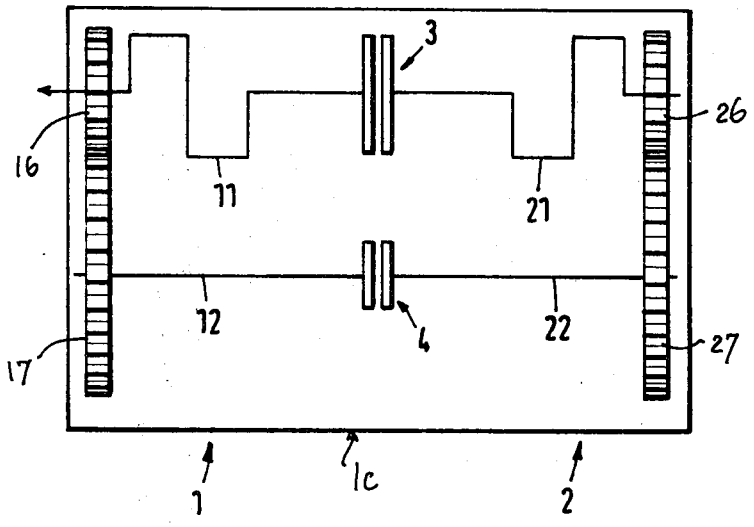
FIG. 2 is a similar diagrammatic sectional view of a second engine with a wet positive-engagement clutch between two coaxial crankshafts and a wet accelerating clutch between two coaxial camshafts.

FIG. 2 illustrates a second embodiment of the improved internal combustion engine. This engine is also composed of two discrete units or sections 1, 2 which, however, comprise a common casing or cylinder block 1*c*. The clutches 3 and 4 are wet clutches, i.e., each thereof is installed in the interior of the casing 1*c*. The transmission ratio of the torque-transmitting gear trains 16, 17 and 26, 27 between the crankshafts 11, 21 and the associated camshafts 12, 22 is preferably the same as described in connection with FIG. 1. It will be noted that the crankshafts 11, 21 of the engine shown in FIG. 2 are also connected in series and are coaxial with each other, the same as the camshafts 12, 22. The sequence in which the clutches 3, 4 are engaged or disengaged is or can be the same as described in connection with FIG. 1. Thus, if the clutch 3 is a positive-engagement clutch and the accelerating clutch 4 is a friction clutch, the clutch 4 accelerates the camshaft 22 to the speed of the camshaft 12 and the clutch 3 is activated upon completion of such acceleration as well as after the crankshaft 21 assumes a predetermined angular position with reference to the crankshaft 11.

Figure 3:
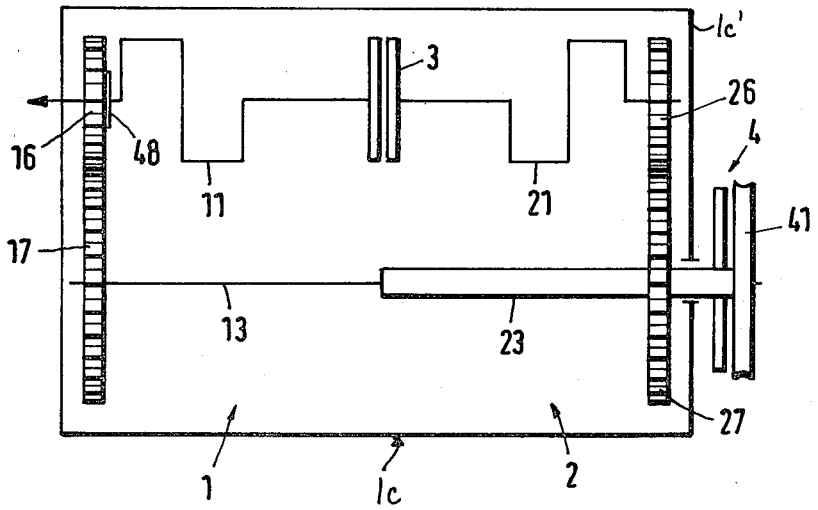
FIG. 3 is a similar diagrammatic sectional view of a third engine with a wet positive-engagement clutch and a dry accelerating clutch.

FIG. 3 illustrates a third internal combustion engine wherein the units or sections 1 and 2 are installed in a common casing or cylinder block 1*c*. The crankshafts 11 and 21 are arranged in series and can be coupled to each other by a wet clutch 3 which is or may be of the type shown in FIG. 2. The camshaft 13 which is rotated by the crankshaft 11 through the medium of the gears 16 and 17 extends in a direction to the right through and beyond the right-hand end wall 1*c*′ of the casing 1*c*. The other camshaft 23 is hollow and rotably receives the right-hand portion of the camshaft 13. The accelerating clutch 4 is installed outside of the casing 1*c* adjacent to the outer side of the end wall 1*c*′. The torque-transmitting connection between the hollow camshaft 23 and the associated crankshaft 21 comprises two mating gears 26 and 27. The right-hand end portion of the camshaft 13 extends beyond the left-hand element of the clutch 4 and carries a rotary member 41 which can transmit motion to certain auxiliary apparatus or devices in the vehicle which embodies the engine of the FIG. 3. Such auxiliary apparatus may include a water pump, a light generator, a cooling fan and/or others. The illustrated rotary member 41 is a pulley which can transmit motion to one or more V-belts or the like. It is also possible to utilize a sprocket wheel which drives one or more chains, not shown. It will be noted that the rotary member 41 is installed at that side of the casing 1*c* which is remote from the crankshaft 11. This is desirable and advantageous because there is more room at the outer side of the end wall 1*c*′ so that the rotary member 41 is readily accessible. The same holds true for the friction clutch 4 which is preferably a dry clutch and is also accessible at the outer side of the end wall 1*c*′. The rotary member 41 can be made integral with the right-hand element of the accelerating clutch 4, i.e., with that element which rotates with the camshaft 13.

The mounting of the rotary member 41 on the camshaft 13 is advisable and advantageous because the camshaft 13 rotates whenever the engine is running, i.e., whenever the crankshaft 11 is rotated by the associated cylinders of the section 1.

If desired, the engine of FIG. 3 can comprise an additional takeoff which may include a rotary member mounted on that portion of the hollow camshaft 23 which extends outwardly and beyond the end wall 1*c*′. Such rotary member may constitute a pulley or a sprocket wheel which rotates a belt or chain for transmission of motion to additional auxiliary equipment of the vehicle which embodies the engine of FIG. 3.

In order to avoid jamming of the drive during simultaneous activation of the clutches 3 and 4, the structure of FIG. 1 further comprises and additional or third clutch 47 which is installed between the crankshaft 21 and the gear 26. Such additional clutch can also be installed between the camshaft 22 and gear 27. An analogous additional clutch is installed between the gear 16 and the crankshaft 11 in the engine of FIG. 3 and is designated by the reference character 48. The clutch 47 or 48 allows for rotation between the parts 21, 26 (FIG. 1) and 11, 16 (FIG. 3) if the clutch 3 is engaged simultaneously with the clutch 4 and the means for transmitting motion to the transmission T tends to jam.

Figure 4:
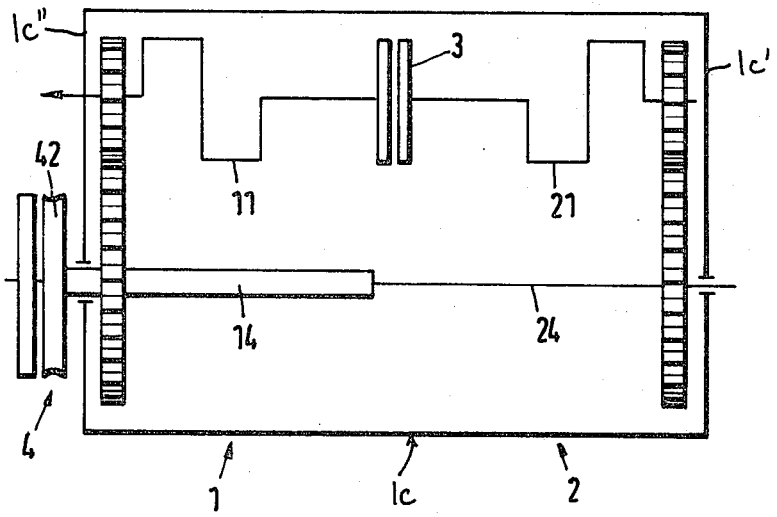
FIG. 4 is a diagrammatic sectional view of an engine which constitutes a modification of the engine shown in FIG. 3.

Referring to FIG. 4, there is shown a further engine which again comprises two units or sections 1, 2 installed in a common casing or cylinder block 1*c*. In this embodiment of the engine, the camshaft 14 which is driven by the crankshaft 11 is hollow and surrounds the left-hand end portion of the second camshaft 24. The manner in which the camshafts 14, 24 are respectively connected with the associated crankshafts 11, 21 is the same as illustrated in FIG. 3. The clutch 3 between the coaxial crankshafts 11 and 21 is a wet clutch which is installed in the interior of the casing 1*c*. The accelerating clutch 4 is a dry friction clutch which is adjacent to the outer side of the left-hand end wall 1*c*″ of the casing 1*c*. The reference character 42 denotes a pulley or an analogous rotary member which is connected with the left-hand end portion of the hollow camshaft 14 and can drive one or more auxiliary apparatus of the vehicle which embodies the engine of FIG. 4. The member 42 may constitute or form part of one element of the friction clutch 4. The right-hand end portion of the camshaft 24 is journalled in right-hand end wall 1*c*′ of the casing 1*c*. If necessary, the left-hand end portion of the camshaft 24 can extend beyond the clutch 4 and can rotate on additional rotary member, such as a pulley or a sprocket wheel, which transmits motion to one or more additional auxiliary apparatus of the vehicle.

Figure 5:
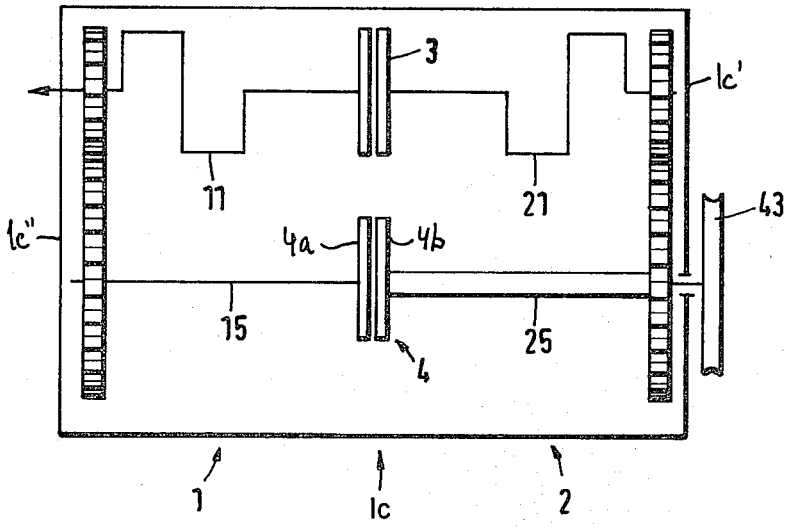
FIG. 5 is a diagrammatic sectional view of an engine which constitutes a modification of the engine shown in FIG. 2.

FIG. 5 illustrates a fifth internal combustion engine with two discrete units or sections 1, 2 installed in a common casing or cylinder block 1*c*. This engine is similar to the engine of FIG. 3 except that the acclerating clutch 4 is a wet clutch which is installed in the interior of the casing 1*c* between the coaxial camshafts 15 and 25. The camshaft 15 extends through the hollow camshaft 25 and through and beyond the right-hand end wall 1*c*′ of the casing 1*c* and carries a rotary member 43 which can perform the same function or functions as the rotary member 41 of FIG. 3 or the rotary member 42 of FIG. 4. The clutch 3 between the crankshafts 11 and 21 is also a wet clutch which may constitute a friction clutch or a positive-engagement clutch. The torque-transmitting connections between the crankshafts 11, 21 on the one hand and the associated camshafts 15, 25 on the other hand are preferably identical with those shown in FIGS. 1–4.

One of the elements 4*a*, 4*b* forming the accelerating clutch 4 is movable axially of the camshafts 15, 25 toward and away from the other clutch element to effect acceleration of the camshaft 25 when the operator of the vehicle desires to start the cylinders which rotate the crankshaft 21 when the engine is operated at maximum load. Within the partial-load range, the crankshaft 21 is idle because the clutch 3 is disengaged so that the transmission receives motion only from the crankshaft 11.

As shown in FIG. 5, the rotary member 43 is preferably adjacent to the outer side of that end wall (1*c*′) which is remote from the transmission (not shown) receiving torque from the crankshaft 11. This allows for convenient access to the rotary member 43 and to the belt or chain which receives motion from such rotary member.

If desired, the left-hand end portion of the camshaft 15 can extend through and beyond the left-hand end wall 1*c*″ of the casing 1*c* to rotate an additional member (a pulley, a sprocket wheel, a cam or the like) if the number of auxiliary apparatus is such that all of them cannot or should not receive motion exclusively from the rotary member 43. Furthermore, the provision of the just mentioned additional rotary member on the left-hand end portion of the camshaft 15 is desirable and advantageous if the auxiliary apparatus receiving motion from the camshaft 15 is to be in use only at a time when the engine of FIG. 5 is operated at maximum load.

Figure 6:
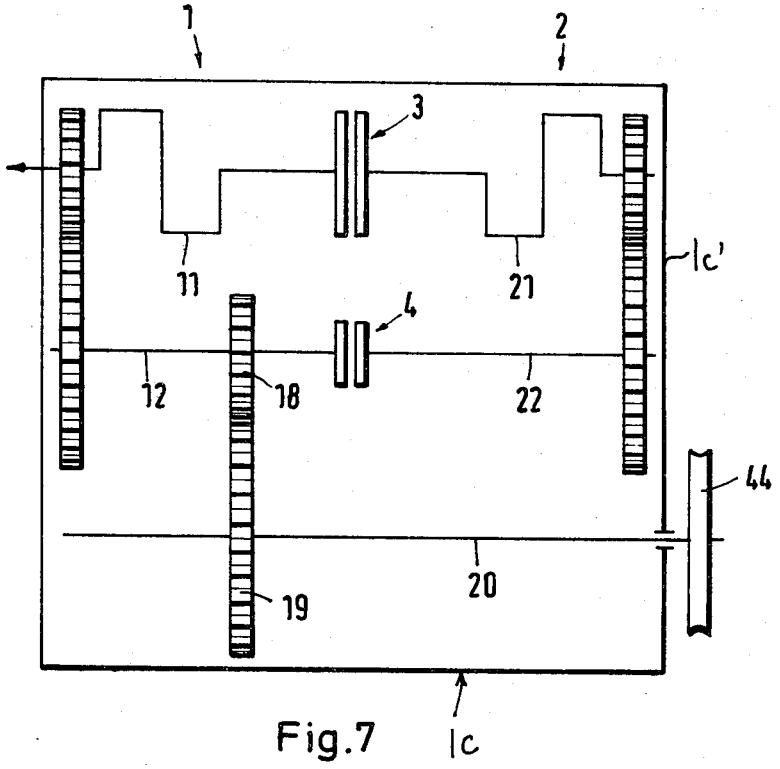
FIG. 6 is a diagrammatic sectional view of an engine which also constitutes a modification of the engine shown in FIG. 2.

Referring to FIG. 6, there is shown an internal combustion engine with two discrete units or sections 1, 2 which are installed in a common casing or cylinder block 1*c*. In this embodiment of the invention, the rotary member 44 which corresponds to the rotary member 41 of FIG. 3, to the rotary member 42 of FIG. 4, or to the rotary member 43 of FIG. 5, is installed on an auxiliary or additional shaft 20 which is parallel to the coaxial camshafts 12, 22 and receives torque from the camshaft 12 through the medium of a gear train including mating spur gears 18 and 19. The auxiliary shaft 20 is journalled in the casing 1*c* and the rotary member 44 (e.g., a pulley or a sprocket wheel) is adjacent to the right-hand end wall 1*c*′ of the casing 1*c*. The engine of FIG. 6 is otherwise similar to the engine of FIG. 2, i.e., the clutches 3 and 4 are wet clutches and the clutch 3 may constitute a positive-engagement clutch which is activated only after the accelerating clutch 4 has completed acceleration of the camshaft 22 to the angular velocity of the camshaft 12 and the camshaft 22 assumes a predetermined angular position with reference to the camshaft 12. This is tantamount to ensuring that the crankshaft 21 assumes a predetermined angular position with reference to the crankshaft 11.

Figure 7:
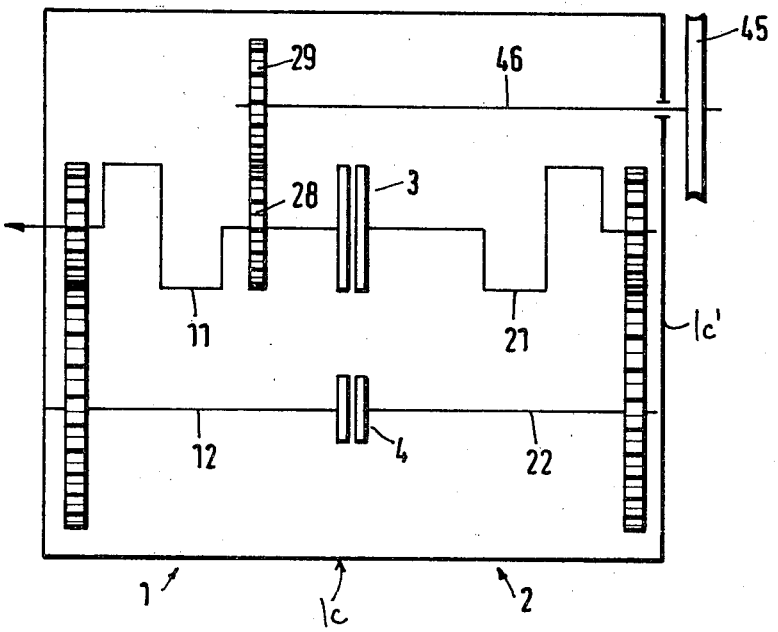
FIG. 7 is a diagrammatic sectional view of an engine which constitutes a modification of the engine shown in FIG. 6.

Referring finally to FIG. 7, there is shown an additional engine comprising two discrete units or sections 1, 2 installed in a common casing or cylinder block 1*c*. In contrast to the construction of FIG. 6, the auxiliary shaft 46 of the engine shown in FIG. 7 receives torque from the continuously rotated crankshaft 11 through the medium of a gear train 28, 29 and extends through and beyond the right-hand end wall 1*c*′ of the casing 1*c*. The exposed end portion of the auxiliary shaft 46 carries a rotary member 45 which is a pulley or a sprocket wheel and can transmit motion to one or more auxiliary apparatus of the vehicle which embodies the engine of FIG. 7.

In each of the embodiments which are shown in FIGS. 6 and 7, it is possible to drive additional auxiliary apparatus through the medium of the camshaft 22. To this end, the camshaft 22 can extend beyond the end wall 1*c*′ to carry an additional rotary member in the form of a cam, pulley or sprocket wheel (not shown) which can transmit motion to additional auxiliary apparatus. The selection of the position of the rotary member or members which forms or form part of one or more power takeoff devices and drive auxiliary apparatus of the vehicle will be made in dependency on the availability of space at the outer side of the casing or cylinder block of the engine.

An important advantage of the improved method and engine is that the second crankshaft 21 can be indirectly accelerated by the first crankshaft 11 through the medium of the camshafts (such as 12, 22) and the clutch 4. This renders it possible to monitor the angular velocities of the camshafts in order to select the timing of engagement or activation of the clutch 3 which directly connects the two crankshafts to each other. In other words, there is no need to directly monitor the angular velocities of the crankshafts 11 and 21 because the ratio of the torque-transmitting connections between the crankshafts and the respective camshafts is fixed.

The improved structure can be incorporated with advantage in four-stroke-cycle engines with four cylinders wherein each of the two units or sections 1 and 2 comprises two cylinders. The selection of the torque transmitting connections between the crankshafts and the respective camshafts is such that each crankshaft completes two revolutions in response to one revolution of the corresponding camshaft. In other words, it is necessary to ensure that the angular position of the crankshaft 21 with reference to the crankshaft 11 is correct within a range of 720 degrees. Were the clutch 4 disposed between the crankshafts, it would be necessary to employ additional safety devices which would prevent coupling of the two crankshafts to each other in angular positions at 360 degrees from proper angular positions. Such safety devices are complex, bulky, sensitive and expensive.

As explained above, the friction clutch 4 can be designed to allow for rotation of the camshafts relative to each other during the initial stage of acceleration of the second crankshaft to the exact speed or close to the speed of the first crankshaft, and to thereupon rotate the two camshafts at the same speed during the next-following (second or last) stage of acceleration which entails, or takes place simultaneously with, activation of the clutch 3 between the crankshafts. Such two-stage operation of the clutch 4 simplifies the task of ensuring that the clutch 3 is engaged only when the crankshaft 21 assumes a predetermined angular position with reference to the crankshaft 11. The arrangement may be such that the second stage of acceleration of the second camshaft (and hence of the second crankshaft) can begin or can be carried out only if the second crankshaft assumes the desired predetermined angular position with reference to the first crankshaft.

Disengagement or deactivation of the accelerating clutch 4 upon activation or engagement of the clutch 3 is desirable and advantageous because it reduces the likelihood of generation of undesirable and excessive internal stresses in the interconnected components of the engine when the crankshafts 11 and 21 are positively coupled to each other.

The clutch 4 is preferably a friction clutch which (as stated above) can positively drive the second camshaft in response to rotation of the first camshaft during the last stage of the accelerating step. The clutch 3 is preferably a positive-engagement (jaw or claw) clutch which is or can be designed in such a way that its clutch members 3*a* and 3*b* can properly engage each other only and alone in the predetermined angular position of the second crankshaft 21 relative to the first crankshaft 11. However, it is equally within the purview of the invention to employ a friction clutch which is designed to establish a slippage-free connection between the crankshafts 11 and 21 as soon as the crankshaft 21 is accelerated to the speed of the crankshaft 11 and assumes the desirable optimum angular position with respect thereto. If the clutch 4 embodies means for establishing a positive torque-transmitting connection between the two camshafts after the acceleration of the second camshaft to the speed of the first camshaft is completed and the second camshaft is held in an optimum angular position relative to the first camshaft, positive engagement between the two crankshafts follows the establishment of positive engagement between the two camshafts, and positive engagement between the camshafts can be terminated as soon as the crankshafts are positively connected to each other. The term "positive connection" is intended to denote a connection which prevents rotation of the crankshaft 21 relative to the crankshaft 11 or vice versa.

The mounting of crankshafts 11 and 21 in series (i.e., one after the other and in such a way that the two crankshafts are coaxial with each other) is one of the presently preferred modes of assembling the internal combustion engine. This renders it possible to mount the two camshafts in series or at least coaxially with each other (depending upon whether or not one of the camshafts is hollow and rotatably receives a portion of the other camshaft). The mounting of clutches 3 and 4 between the coaxial crankshafts and between the coaxial camshafts, respectively, simplifies the design of the engine and contributes to compactness of the cylinder block or blocks.

An advantage of utilizing a hollow camshaft so that the other camshaft can extend therethrough is that such construction renders it possible to install the friction clutch externally of the cylinder block or blocks so that the friction clutch is readily accessible. This also allows for the use of a dry friction clutch even if the two sections of the engine have a common cylinder block or casing. Still further, this renders it possible to construct the power takeoff in such a way that its input element can form an integral or separable part of one of the camshafts, preferably of that camshaft which extends beyond the other camshaft and from the casing or cylinder block of the engine. As explained hereinbefore, the exact location of the power takeoff and/or of a clutch 4 which is installed externally of the casing will be selected in dependency on the availability of space around the cylinder block or blocks. As a rule, the space is readily available in the region of that end wall (1*c*′) which is remotest from the first crankshaft 11 because the first crankshaft is normally closely adjacent to the transmission T whose input element is driven by the engine. However, and as shown in FIG. 4, it can happen that sufficient or a larger amount of space is available in the region of the wall 1*c*″, i.e., in the region of that wall which is nearer to the transmission and is remotest from the second crankshaft 21. The takeoff can comprise two or more coaxial pulleys, sprocket wheels or like rotary members.

The structure which is shown in the lower part of FIG. 6 and in the upper part of FIG. 7 can be provided in addition to a power takeoff of the type shown in FIGS. 3, 4 or 5. Thus, a first power takeoff can be rotated by one of the camshafts, and a second power takeoff may comprise an auxiliary or additional shaft (20 or 46) which receives torque from one of the camshafts or from one of the crankshafts.

The provision of the third clutch 47 or 48 is advisable and necessary when the friction clutch 4 is fully engaged simultaneously with the clutch 3. Under such circumstances, the parts of the engine can be or could be subjected to excessive or undesirable deforming stresses. The clutch 47 or 48 is disengaged or deactivated during simultaneous engagement of the clutches 3, 4 or under any other circumstances which could lead to development of excessive stresses in the parts of the illustrated engine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of establishing a separable connection between a rotating first crankshaft and a second crankshaft in an internal combustion engine wherein the first and second crankshafts respectively form part of discrete first and second units and the first and second units respectively further comprise first and second cylinder means for rotating the respective crankshafts and first and second camshafts rotating with the respective crankshafts, comprising the steps of accelerating the second crankshaft through the medium of the first camshaft; and thereupon connecting the second crankshaft with the rotating first crankshaft.

2. The method of claim 1, wherein said accelerating step comprises accelerating the second crankshaft through the medium of the second camshaft until the speed of the second camshaft at least approximates the speed of the first camshaft.

3. The method of claim 1, wherein said accelerating step comprises accelerating the second crankshaft through the medium of said second camshaft until the speed of the second crankshaft at least approximates the speed of the first crankshaft.

4. The method of claim 3, wherein said accelerating step further comprises moving the second crankshaft to a predetermined angular position with reference to the first crankshaft preparatory to said connecting step.

5. The method of claim 1, wherein said accelerating step includes accelerating the second crankshaft through the medium of the first and second camshafts, first with relative movement between the camshafts and thereupon without such relative movement.

6. The method of claim 5, further wherein said connecting step comprises establishing a positive torque-transmitting connection between the first and second crankshafts in response to completion of that stage of said accelerating step which involves relative movement between the camshafts.

7. The method of claim 5, wherein said connecting step includes establishing a positive torque-transmitting connection between the crankshaft simultaneously with completion of acceleration of the second camshaft to the speed of the first camshaft.

8. The method of claim 1, further comprising the step of terminating the accelerating action of the first camshaft upon the second crankshaft on completion of said connecting step.

9. The method of claim 8, wherein said accelerating step includes accelerating the second crankshaft through the medium of the first and second camshafts and said terminating step includes disconnecting the second camshaft from the first camshaft.

10. The method of claim 1, wherein said accelerating step includes accelerating the second camshaft to a speed which at least approximates the speed of the first camshaft whereby the second camshaft accelerates the second crankshaft, terminating said accelerating step when the second camshaft reaches the speed of the first camshaft and assumes a predetermined angular position with reference to the first camshaft, and establishing a positive torque-transmitting connection between the first and second camshafts after the second camshaft assumes said predetermined angular position, said establishing step preceding or taking place simultaneously with said connecting step.

11. The method of claim 1, wherein said accelerating step includes establishing a frictional torque transmitting connection between the first and second camshafts whereby the first camshaft accelerates the second camshaft and the second camshaft accelerates the second crankshaft, and further comprising the step of terminating said accelerating step when the speed of the second crankshaft at least approximates the speed of the first crankshaft and the second crankshaft assumes a predetermined angular position with reference to the first crankshaft, said connecting step following said terminating step and including establishing a positive torque-transmitting connection between the first and second crankshafts.

12. The method of claim 1, wherein said accelerating step is carried out in two stages the first of which includes accelerating the second crankshaft through the medium of the first and second camshafts with relative movement between the first and second camshafts and the second of which includes rotating the camshafts without such relative movement, said connecting step including establishing a frictional torque-transmitting connection between the first and second crankshafts.

13. In an internal combustion engine, the combination of a first engine section having a normally rotating first crankshaft rotatable by first cylinder means and a first camshaft rotatable by said first crankshaft; a second engine section having a second crankshaft rotatable by second cylinder means, a second camshaft and means for transmitting torque between said second crankshaft and said second camshaft; means for accelerating said second crankshaft, including first clutch means interposed between said camshafts and actuatable to rotate said second crankshaft in response to rotation of said first camshaft; and second clutch means for connecting said crankshafts to each other on acceleration of said second crankshaft.

14. The combination of claim 13, wherein said crankshafts are disposed in series.

15. The combination of claim 13, wherein said first and second camshafts are coaxial with each other.

16. The combination of claim 15, wherein said camshafts are disposed in series.

17. The combination of claim 13, wherein at least one of said clutches is a dry clutch.

18. The combination of claim 13, wherein each of said sections further comprises a discrete cylinder block for the respective shafts.

19. The combination of claim 18, wherein at least one of said clutch means is disposed between said blocks.

20. The combination of claim 18, wherein said second clutch means is disposed between said blocks and said first clutch means is a dry clutch.

21. The combination of claim 13, wherein one of said camshafts is hollow and the other of said camshafts is coaxial with and extends into the interior of said one camshaft.

22. The combination of claim 13, further comprising casing means for said shafts, said casing means having a wall remote from said first crankshaft and said first clutch means being adjacent to said wall.

23. The combination of claim 22, wherein said second camshaft is hollow and said first camshaft is coaxial with and extends into said second camshaft.

24. The combination of claim 22, further comprising a power takeoff receiving torque from said first camshaft.

25. The combination of claim 24, wherein said power takeoff forms part of said first clutch means.

26. The combination of claim 25, wherein said first clutch means is disposed outside of said casing means.

27. The combination of claim 24, wherein said power takeoff comprises a pulley.

28. The combination of claim 13, further comprising casing means for said shafts, said first camshaft being hollow and said second camshaft being coaxial with and extending into said hollow first camshaft.

29. The combination of claim 28, wherein said casing means has a wall remote from said second crankshaft and said first clutch means is adjacent to said wall.

30. The combination of claim 29, wherein said first clutch means is located outside of said casing means.

31. The combination of claim 28, further comprising a power takeoff receiving torque from said first camshaft.

32. The combination of claim 31, wherein said power takeoff forms part of said first clutch means.

33. The combination of claim 31, wherein said power takeoff comprises a pulley.

34. The combination of claim 13, wherein said first clutch means is disposed between said sections and one of said camshafts is hollow, the other camshaft being coaxial with and extending into the interior of said one camshaft.

35. The combination of claim 34, wherein said other camshaft is said first camshaft.

36. The combination of claim 35, wherein said sections are disposed side-by-side and said first camshaft includes a portion which extends beyond said second section.

37. The combination of claim 36, further comprising a power takeoff receiving torque from said portion of said first camshaft.

38. The combination of claim 13, further comprising a power takeoff including an additional shaft and means for transmitting torque from one of said camshafts to said additional shaft.

39. The combination of claim 38, wherein said one camshaft is said first camshaft.

40. The combination of claim 13, further comprising a power takeoff including an additional shaft and means for transmitting torque from one of said crankshafts to said additional shaft.

41. The combination of claim 40, wherein said one crankshaft is said first crankshaft.

42. The combination of claim 13, further comprising means for transmitting torque between said first crankshaft and said first camshaft.

43. The combination of claim 42, wherein at least one of said torque transmitting means comprises a gear train.

44. The combination of claim 13, further comprising disengageable third clutch means interposed between said first crankshaft and said first camshaft, said third clutch means being disengageable upon activation of said second clutch means.

45. The combination of claim 13, wherein said torque transmitting means comprises disengageable third clutch means, said third clutch means being disengageable upon engagement of said second clutch means.

46. Apparatus for connecting or disconnecting first and second sections of an internal combustion engine, comprising first and second rotary crankshafts respectively forming part of said first and second sections; accelerating means operable to raise the speed of said second crankshaft to at least approximate the speed of said first crankshaft, said accelerating means comprising a camshaft receiving torque from said first crankshaft and constituting the input element of said accelerating means; and clutch means operative to positively couple said crankshafts to each other upon completed acceleration of said second crankshaft.

47. The apparatus of claim 46, wherein said accelerating means further comprises a second camshaft, means for transmitting torque from said first to said second camshaft, and means for rotating said second crankshaft in response to rotation of said second camshaft.

48. Apparatus for connecting or disconnecting first and second sections of an internal combustion engine, comprising first and second rotary crankshafts respectively forming part of said first and second sections; accelerating means operable to raise the speed of said second crankshaft to at least approximate the speed of said first crankshaft; first clutch means operative to positively couple said crankshafts to each other upon completed acceleration of said second crankshaft; a first rotary camshaft driven by said first crankshaft; and a second rotary camshaft coaxial with said first camshaft and arranged to drive said second crankshaft, said accelerating means including second clutch means interposed between said camshafts.

49. Apparatus for connecting or disconnecting first and second sections of an internal combustion engine, comprising first and second rotary crankshafts respectively forming part of said first and second sections; accelerating means operable to raise the speed of said second crankshaft to at least approximate the speed of said first crankshaft; clutch means operative to positively couple said crankshafts to each other upon completed acceleration of said second crankshaft; first and second camshafts; means for rotating said first camshaft in response to rotation of said first crankshaft; means for rotating said second crankshaft in response to rotation of said second camshaft, said clutch means being interposed between said crankshafts and said accelerating means including a friction clutch interposed between said camshafts; a casing for said shafts; and a power takeoff including a rotary member disposed outside of said casing and means for transmitting torque from said first crankshaft to said rotary member.

50. The apparatus of claim 49, wherein said means for rotating said first camshaft includes a gear train between said first crankshaft and said first camshaft, said means for transmitting torque to said rotary member including a further gear meshing with a gear of said gear train and a shaft connecting said further gear with said rotary member.

51. The apparatus of claim 49, wherein said rotary member is a pulley.

52. The apparatus of claim 49, wherein said second camshaft is hollow and said torque transmitting means includes a portion connecting said first camshaft with said rotary member and extending through said hollow second camshaft.

53. The apparatus of claim 52, wherein said portion is a coaxial extension of said first camshaft which is rotatably journalled in said second camshaft.

* * * * *